United States Patent [19]

Holowaty

[11] 4,342,622

[45] Aug. 3, 1982

[54] PROCESS FOR MAKING FORMED COKE FROM HIGH SULFUR COAL

[75] Inventor: Michael O. Holowaty, Crown Point, Ind.

[73] Assignee: Inland Steel Company, Chicago, Ill.

[21] Appl. No.: 237,510

[22] Filed: Feb. 23, 1981

Related U.S. Application Data

[63] Continuation-in-part of Ser. No. 147,916, May 8, 1980, abandoned.

[51] Int. Cl.[3] ..... C10B 39/02; C10B 57/00

[52] U.S. Cl. ..... 201/6; 201/17; 201/39; 202/228

[58] Field of Search ..... 201/6, 17, 39; 202/95, 202/228, 253; 44/1 SR; 208/212

[56] References Cited

U.S. PATENT DOCUMENTS

| | | | |
|---|---|---|---|
| 2,717,868 | 9/1955 | Gorin et al. | 202/31 |
| 3,073,751 | 1/1963 | Gorin et al. | 202/26 |
| 3,117,918 | 1/1964 | Batchelor et al. | 201/17 |
| 3,671,401 | 6/1972 | Gorin | 201/12 |
| 4,097,245 | 6/1978 | Holowaty | 201/6 |
| 4,104,129 | 8/1978 | Fields et al. | 201/17 |
| 4,203,960 | 5/1980 | Bauer et al. | 201/17 |

OTHER PUBLICATIONS

"Thermal Processing is Developed for Petroleum Coke Desulfurization"; Sze et al.; Oil & Gas Journal; pp. 64–68; 1-22-79.

*Primary Examiner*—Bradley Garris

*Attorney, Agent, or Firm*—Merriam, Marshall & Bicknell

[57] ABSTRACT

In a formed coke process of the type in which carbonization and calcination of coal is carried out prior to briquetting, the hot calcined char is cooled by means of a hydrogen-rich gas at superatmospheric pressure so as to effect concurrent cooling and desulfurization of the char. High sulfur coal containing 1.5 to 4 wt. % sulfur can be used while obtaining a char and a formed coke product with a sulfur content of 0.8 wt. % or less. The cooling can be done in two stages: (1) a first stage in which sulfur removal and cooling to a temperature not lower than about 800° F. are accomplished with a hydrogen-rich gas, and (2) a second stage in which further cooling to about 200° F. or less is accomplished with an inert gas.

19 Claims, 2 Drawing Figures

PROCESS FOR MAKING FORMED COKE FROM HIGH SULFUR COAL

This application is a continuation-in-part of application Ser. No. 147,916, filed May 8, 1980, now abandoned.

This invention relates to an improved process for making formed coke and more particularly to a process modification which makes feasible the use of coals of relatively high sulfur content.

Heretofore, it has been necessary to limit the coals to be used for making formed coke to those containing not more than about 1.0 wt.% sulfur since no practical and effective way has been used commercially to eliminate sulfur either before or during or after the coking process. Thus, it has been difficult to take advantage of the available high sulfur coals containing, for example, from 1.5 to 4 wt.% sulfur.

It has been known for many years that at high temperatures both the organic sulfur and the inorganic sulfur in coal, coke, or char can be reacted with gaseous hydrogen to form hydrogen sulfide. Economic and practical considerations, however, have discouraged any commercial utilization of this method of desulfurization. In certain types of formed coke processes it has also been proposed to reduce the sulfur content of the end product by various means including the use of a reducing gas during a calcining stage. Examples of such proposals are found in the following U.S. Patents: Gorin et al U.S. Pat. No. 2,717,868, Gorin et al U.S. Pat. No. 3,073,751, Batchelor et al U.S. Pat. No. 3,117,918, and Gorin U.S. Pat. No. 3,671,401. None of the aforementioned proposals, however, has provided an inexpensive and commercially feasible procedure for eliminating sulfur in the manufacture of formed coke. Consequently, it has been necessary to continue the existing practice of using only coals of low or moderate sulfur content for making formed coke of metallurgical quality.

A primary object of the present invention is to provide an improved process for the manufacture of formed coke in order to effect sulfur removal in an economical and practical manner.

Another object of the invention is to provide an improved process for making formed coke which permits the use of high sulfur coals.

A further object of the invention is to provide an improved formed coke process wherein removal of sulfur is effected during cooling of a high temperature calcined char prior to blending the char with a binder for briquetting.

Figure 1:
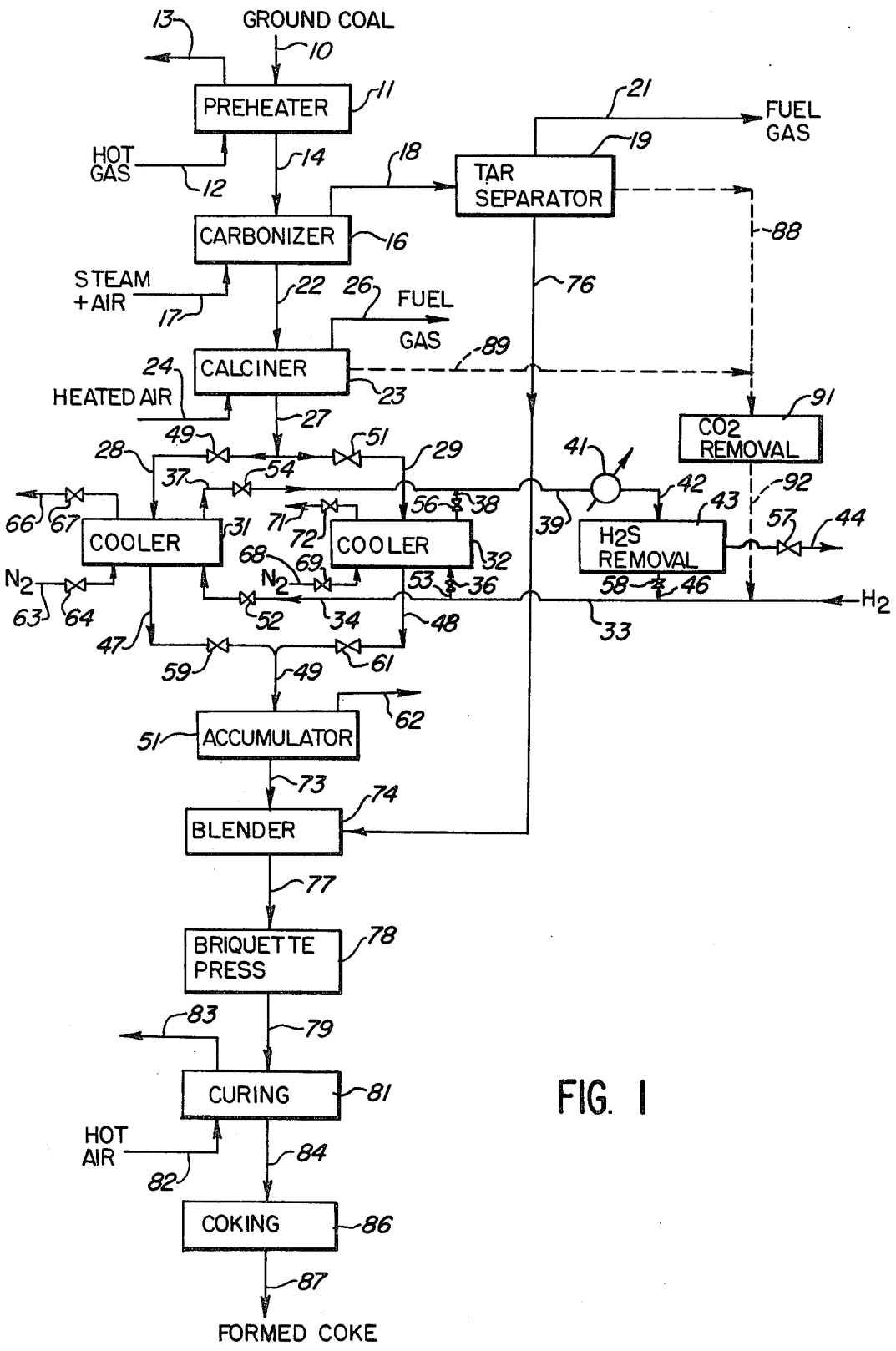
Figure 2:
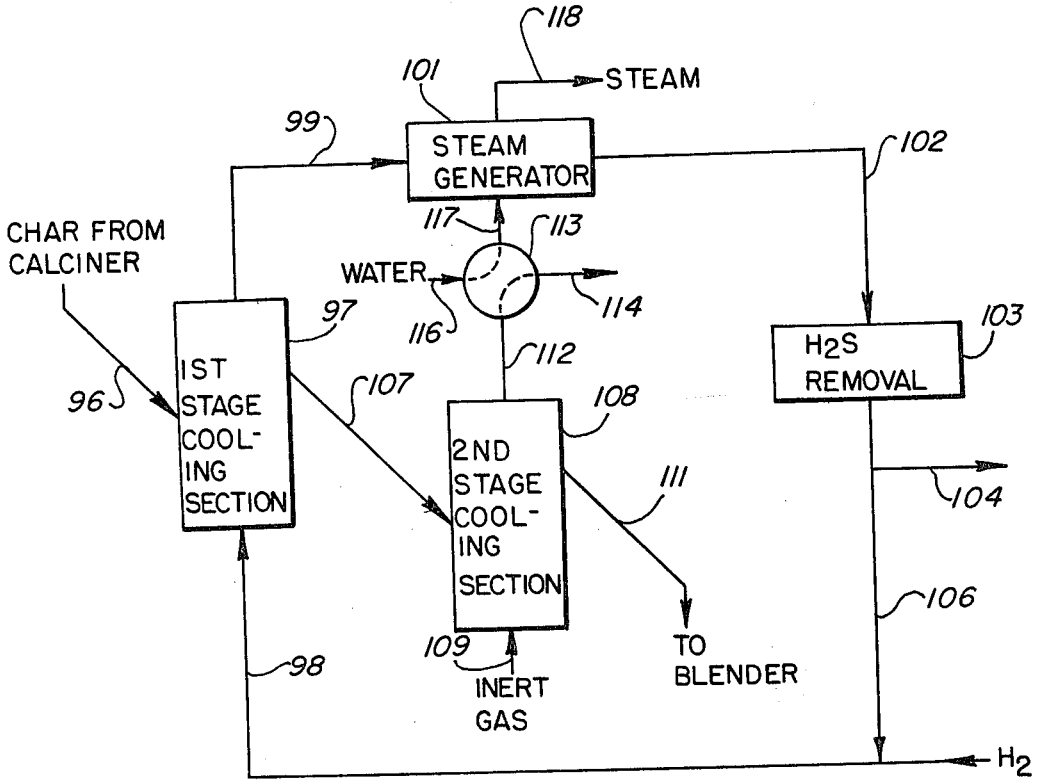

Other objects and advantages of the invention will be understood from the following detailed description with reference to the accompanying drawings, wherein:

FIG. 1 is a schematic flow diagram of a formed coke process incorporating the improvement of the present invention; and FIG. 2 is a schematic flow diagram showing a modification of the process.

Formed coke processes can be categorized broadly into two types: (1) those in which the coal is briquetted first and then carbonized, and (2) those in which the coal is carbonized first and the resulting char is then formed into briquettes. In some formed coke processes of the latter type in which the coal is carbonized prior to briquetting, it is necessary to cool the char before blending with a low temperature liquid binder such as pitch or other coal tar derived material. Usually the char is cooled by means of an inert gas or steam from a high temperature range of about 1400° to 1600° F. (760° to 871° C.) to a low temperature range of about 200° to 250° F. (93° to 121° C.) before being blended with the binder.

In accordance with the present invention, the cooling of the hot char is accomplished by means of a reducing gas containing predominantly hydrogen whereby to effect concurrent cooling and desulfurization of the char. Thus, the desulfurization is carried out as an integral part of the formed coke process as an incident to the char cooling step of the process and without the necessity of special process steps solely for effecting sulfur removal.

Referring to the drawings, FIG. 1 is a schematic flow diagram showing the manner in which the present invention may be utilized in connection with a known commercial formed coke process, the FMC process, which is characterized by carrying out the carbonization of coal in two stages. Although FIG. 1 refers only to the principal features of the process, the details are well known to those skilled in the art and are described more fully in the Work et al U.S. Pat. Nos. 3,184,293 and 3,140,241 which are incorporated herein by reference.

As shown in FIG. 1, the coal is first ground or crushed to the desired particle size and is introduced at 10 to a preheater step 11 into which hot gas is introduced through 12 and removed at 13, thereby effecting drying, preoxidation, and preheating of the particulate coal. The coal then passes by line 14 to a carbonizer stage 16 in which the preheated coal is partially devolatilized with steam and air introduced at 17. The volatile material evolved during carbonization is removed through line 18 to a tar separator 19 from which a fuel gas is withdrawn through line 21. The carbonization of the coal in carbonizer 16 is carried out by combustion of a portion of the coal to obtain a temperature ranging from about 860° to about 1000° F. (460° to 538° C.). The resultant char passes through line 22 to a calciner stage 23 to which heated air is introduced through line 24. In this stage, combustion of a portion of the char is effected to obtain a substantially higher temperature ranging from about 1400° to about 1600° F. (760° to 871° C.) so as to effect final devolatilization. The effluent gas, which may also be used as fuel gas, is removed at 26. Preferably, the preheating in zone 11, the carbonization in zone 16, and the calcination in zone 23 are each carried out as fluidized bed operations at pressures only slightly above atmospheric ranging from a few inches to about one foot of water.

Before the calcined char can be blended with a low temperature binder preparatory to briquetting, the char must be cooled. Accordingly, the hot char is withdrawn from the calciner 23 by line 27 for introduction into a cooling section. In a conventional formed coke process of this type, an inert gas such as nitrogen or steam is passed through a cooler in contact with the hot char and after being filtered is vented to the atmosphere. In accordance with the present invention, however, the cooling gas comprises a reducing gas containing predominantly hydrogen. For effective desulfurization of the calcined char by means of hydrogen, the combined cooling and desulfurization step should be carried out under superatmospheric pressure, preferably from about 30 to about 150 psi, and typically about 75 psi. Since the preceding operations in zones 11, 16, and 23 are conducted at substantially atmospheric pressure or pressures only slightly above atmospheric, the higher pressure cooling-desulfurization step requires a semi-continuous mode of operation utilizing a plurality of cooling vessels in order to accomodate the change in pressure level.

Thus, in FIG. 1 the line 27 is connected to branch lines 28 and 29 for introducing the hot calcined char into a pair of coolers 31 and 32, respectively. The hydrogen-rich reducing gas is introduced through line 33 and passes through branch lines 34 and 36 to the respective coolers. The effluent reducing gas is removed through branch lines 37 and 38 and is passed through line 39 to a heat exchanger 41 where heat is recovered, and the cooled gas is then passed through line 42 to a hydrogen sulfide removal stage 43. The resultant gas of diminished hydrogen sulfide content, preferably less than about 0.05 vol.% $H_2S$, may be removed through line 44 but preferably is recycled through lines 46 and 33 to the coolers 31 and 32. Any known method of removing hydrogen sulfide from gases may be used in stage 43, e.g. by reaction with sulfur dioxide, as in the Claus process, or by absorption in an aqueous solution of an alkanolamine such as ethanolamine, or sodium phenolate, or sodium or ammonium thioarsenate, as in the Thylox process. The cooled char passes from the coolers 31 and 32 through branch lines 47 and 48, respectively, to a line 49 and thence to an accumulator or storage vessel 51.

The lines 28, 29, 34, 36, 37, 38, 44, 46, 47, and 48 are provided with valves 49, 51, 52, 53, 54, 56, 57, 58, 59, and 61 respectively, so that by manipulation of the valves in a conventional manner the cooler vessels 31 and 32 may be used alternately for effecting semi-continuous cooling and desulfurization of the calcined char. In a typical operating cycle, when cooler 31 is being charged with hot char from line 27 and reducing gas is being passed through a previously introduced charge of hot char in cooler 32, the valves 49, 53, 56, and 58 will be open, and the valves 51, 52, 54, 57, 59, and 61 will be closed. Upon completion of the cooling-desulfurization step in cooler 32, and while cooler 31 is still being charged, the open valves 53 and 56 are moved to closed position and the closed valve 61 is then opened, and the batch of cooled and desulfurized char is discharged from the cooler 32 through the lines 48 and 49 into the accumulator 51. The pressurized reducing gas in the cooler 32 is discharged along with the char into the accumulator 51, and the gas is then vented through line 62 so that the accumulator is at essentially atmospheric pressure.

After the foregoing steps, the essentially uninterrupted flow of hot calcined char from line 27 is then switched to empty cooler 32 by substantially simultaneously closing valves 49 and 61 and opening valve 51. At the same time the flow of reducing gas through the cooler 31, the heat exchanger 41, and the $H_2S$ removal stage 43 is initiated by opening valves 52 and 54. Upon completion of the cooling-desulfurization step in cooler 31, and while cooler 32 is still being charged, the open valves 52 and 54 are closed and the closed valve 59 is then opened to permit pressurized discharge of char from the cooler 31 through lines 47 and 49 into the accumulator 51, the gas being vented through line 62. The cycle is then repeated by switching the uninterrupted flow of hot calcined char back to the now empty cooler 31 by substantially simultaneously closing valves 51 and 59 and opening valve 49. The flow of reducing gas through the cooler 32, the heat exchanger 41, and the $H_2S$ removal stage 43 is also resumed by opening valves 53 and 56. During the above-described operating cycle the extent of recycling of the reducing gas through the coolers 31 and 32 may be regulated by adjustment of the valves 57 and 58.

Also, upon completion of the charging of a cooler with a fresh batch of hot calcined char, it will generally be desirable to purge each batch with an inert gas such as nitrogen before introducing the hydrogen-rich reducing gas into the cooler. The purge step avoids the possibility of explosive reaction of hydrogen with oxygen or air contained in the calcined char. Even when the amount of oxygen or air in the char is below explosive levels, the purge step provides the additional benefit of avoiding consumption and loss of expensive hydrogen which will react preferentially with oxygen rather than sulfur. Thus, nitrogen may be introduced into the cooler 31 through a line 63 containing valve 64, and the purge stream is vented through a line 66 having valve 67. A similar nitrogen inlet line 68 with valve 69 and a similar vent line 71 with valve 72 are connected to the cooler 32.

The reducing gas introduced through line 33 may consist essentially of hydrogen or may also contain minor amounts of methane or other lower molecular weight hydrocarbons such as ethane, propane, etc. For optimum desulfurization, however, the gas should be predominantly hydrogen and preferably should be essentially free of hydrogen sulfide and oxides of carbon, i.e. carbon dioxide and carbon monoxide, which are not effective agents for reaction with sulfur under the conditions of the cooling stage. In any case, the combined content of carbon dioxide and carbon monoxide in the hydrogen-rich reducing gas should not exceed about 1 vol.%, and the hydrogen sulfide content should be less than about 0.5 vol.%. Since nitrogen is an inert diluent, the hydrogen-rich reducing gas should also have a low nitrogen content and should preferably be essentially nitrogen-free.

The reaction of gaseous hydrogen with the sulfur compounds in the char to form hydrogen sulfide takes place at temperatures above about 800° F. (427° C.), and particularly above about 1100° F. (593° C.). Therefore, as the reducing gas stream flows through the coolers 31 and 32, concurrent cooling and desulfurization of the char is accomplished during the period of time when the temperature of the char is being lowered from the calcination temperature range of about 1400°-1600° F. (760°-871° C.) to a minimum of about 800° F. (427° C.), and thereafter the char is cooled to about 200° F. (93° C.) or lower without any substantial further desulfurization.

The cooled and desulfurized char passes from the accumulator 51 through line 73 to a blender 74 where the char is blended with pitch or other liquid coal tar material which is introduced to the blender stage 74 by a line 76 from the tar separator stage 19. The blend passes through line 77 to a briquette press 78. The briquettes are introduced by line 79 into a curing oven 81 which is heated with hot air entering through a line 82. Gases are removed from the curing oven 81 through a line 83. The cured briquettes pass from the curing oven 81 through line 84 into coking zone 86, and the formed coke product is removed at line 87. Because of the desulfurization accomplished in the coolers 31 and 32, the char removed in line 73 and the formed coke removed in line 87 will have an advantageously low sulfur content not greater than about 0.8 wt.% even though the original coal has a relatively high sulfur content of about 1.5 to 4 wt.%.

Although any convenient source of hydrogen rich gas may be used for cooling purposes in the coolers 31 and 32, it is particularly desirable to be able to use a hydrogen-containing gas which is produced during the formed coke process. Accordingly, by appropriate modifications of the carbonizing and calcining steps of the process, the gas produced in these steps may have a composition which permits its use in the coolers 31 and 32. For example, the gas introduced though lines 17 and 24 to the carbonizer 16 and calciner 23, respectively, may comprise a mixture of oxygen and steam, in which case the effluent gases from these zones are essentially free of nitrogen. In such case, as shown in dashed lines in FIG. 1, effluent gas streams may be removed from the tar separator 19 and the calciner 23 through lines 88 and 89, respectively, and may be passed separately or in combination to a carbon dioxide removal zone 91 where carbon dioxide is removed from the gas stream by any known means, e.g. by absorption in an aqueous solution of sodium or potassium carbonate or an alkanolamine such as ethanolamine, as in the Girbotol process. The effluent gas of diminished carbon dioxide content, or preferably essentially free of carbon dioxide, is passed through line 92 to line 33 for introduction into the coolers 31 and 32 in the manner previously described.

In addition to the modification of the FMC process described above, other modifications of the formed coke process may also be used in which the gases evolved during the carbonization and calcination stages are suitable for use as the coolant and reducing gas in the cooler. For example, the gas evolved in the formed coke process described in Holowaty U.S. Pat. No. 4,097,245 may be utilized in essentially the same manner as shown in the dashed line modification of FIG. 1.

As heretofore mentioned, the reaction of hydrogen with the sulfur content of the char to form hydrogen sulfide does not occur to any useful degree at temperatures below about 800° F. (427° C.). Accordingly, in the operation shown in FIG. 1, after the temperature in cooler 31 or 32 drops to a level not lower than about 800° F. (427° C.) in a first cooling stage, the flow of hydrogen-rich reducing gas may be discontinued and the remainder of the cooling to about 200° F. (93° C.) or less may be accomplished in a second cooling stage by passing nitrogen or other inert gas through the cooler. In some cases, however, it may be advantageous and desirable to carry out the two-stage desulfurization and cooling of the char in separate sections or vessels, as shown in FIG. 2. A fluid stream, such as water, may be passed successively in heat exchange relation with the effluent gases from each of the vessels to recover heat from the gases.

Referring to FIG. 2, the hot char from the calciner is introduced through a line 96 to a first stage cooling section 97 which may comprise, for example, the coolers 31 and 32 and the accumulator 51 shown in FIG. 1. In the cooling section 97 the temperature of the char is lowered from the range of about 1400°–1600° F. (760°–871° C.) to a temperature not lower than about 800° F. (427° C.) by contacting the char with a predominantly hydrogen containing reducing gas introduced through line 98. Thus, concurrent cooling and desulfurization occurs in the first stage cooling section 97.

The effluent hot gas is removed from the first stage cooling section 97 by line 99 and is passed through a heat exchanger 101 comprising, in this instance, a steam generator. The effluent gas is removed from the heat exchanger 101 through line 102 and is passed to a hydrogen sulfide removal zone 103. The effluent gas from the hydrogen sulfide removal zone 103 may be removed through line 104 but preferably is recycled through lines 106 and 98 to the first stage cooling section 97.

The partially cooled char is passed from the first stage cooling section 97 through a line 107 to a second stage cooling section 108 which may be at substantially atmospheric pressure. The temperature of the char is lowered to about 200° F. (93° C.) or less by means of an inert gas such as steam or nitrogen introduced to the second stage cooling section 108 through a line 109. The cooled char is removed from the second stage cooling section 108 through a line 111 for passage to the blender. Hot effluent gas is removed from the second stage cooling section 108 through a line 112 and passes through a preheater 113 and is removed at 114. Water is introduced to the preheater 113 through a line 116, and the preheated water then passes through a line 117 to the steam generator 101 where the water is further heated and converted to steam which is removed through line 118.

Although the invention has been described with particular reference to certain specific embodiments, it will be understood that various modifications and alternatives may be resorted to without departing from the scope of the invention as defined in the appended claims.

I claim:

1. In a process for making formed coke wherein sulfur-containing coal is subjected to carbonization and high temperature calcination, the resultant hot calcined char is cooled by contacting the char with a cooling gas, the cooled char is blended with a binder, and the blend is formed into briquettes which are heated to produce formed coke;

the improvement permitting the use of high sulfur coal which comprises:

introducing hot, calcined, sulfur-containing char into a cooling-desulfurization zone; and contacting said char in said cooling-desulfurization zone at desulfurizing conditions with a reducing gas containing predominantly hydrogen, whereby to effect concurrent cooling and desulfurization of said char.

2. The process of claim 1 wherein said cooling-desulfurization zone is maintained at a superatmospheric pressure of from about 30 to about 150 psi.

3. The process of claims 1 or 2 wherein the temperature of said char introduced into said cooling-desulfurization zone is from about 1400° F. to about 1600° F. (760° to 871° C.).

4. The process of claim 1 wherein the carbon oxide content of said reducing gas does not exceed about 1 vol.%.

5. The process of claim 1 wherein the effluent gas from said cooling-desulfurization zone is treated to remove hydrogen sulfide and is recycled to said cooling-desulfurization zone.

6. The process of claim 5 wherein the effluent gas from said cooling-desulfurization zone is passed through a heat exchanger for recovery of heat prior to removal of hydrogen sulfide from the gas.

7. The process of claim 1 wherein the gas formed during carbonization or calcination of the coal is essentially free of nitrogen and is treated for removal of carbon dioxide and is then supplied as the reducing gas in said cooling-desulfurization zone.

8. The process of claim 1 wherein said hot, calcined, sulfur-containing char is cooled and desulfurized in a first cooling stage by contacting the char with said reducing gas and is thereafter cooled further in a second cooling stage by contacting the char with an inert gas.

9. The process of claim 8 wherein the hot, calcined, sulfur-containing char is cooled to a temperature not lower than about 800° F. (427° C.) in said first stage and to about 200° F. (93° C.) or less in said second stage.

10. The process of claim 8 wherein a fluid stream is passed successively in heat exchange relation with the effluent gases from each of said cooling stages to recover heat from said gases.

11. A process for making formed coke from sulfur-containing coal which comprises the steps of:

heating the coal in a carbonization zone to effect carbonization;

separating the gas evolved in said carbonization zone from the resultant char, separating tar from said gas evolved in said carbonization zone;

transferring the char from said carbonization zone to a high temperature calcination zone and calcining said char;

removing hot, calcined, sulfur-containing char from said calcination zone and introducing the char into a cooling-desulfurization zone;

passing through said cooling-desulfurization zone in contact with said char a reducing gas containing predominantly hydrogen and maintaining said cooling-desulfurization zone at superatmospheric pressure, whereby to effect concurrent cooling of the char and removal of sulfur from the char by reaction with hydrogen to form hydrogen sulfide, withdrawing an effluent gas from said cooling-desulfurization zone and removing hydrogen sulfide from said effluent gas;

recycling the resultant gas of diminished hydrogen sulfide content to said cooling-desulfurization zone;

blending cooled char removed from said cooling-desulfurization zone with a binder comprising said tar and forming green briquettes from the blend; and heating said green briquettes to produce formed coke.

12. The process of claim 11 wherein said superatmospheric pressure is from about 30 to about 150 psi.

13. The process of claims 11 or 12 wherein the temperature in said carbonization zone is from about 860° F. to about 1000° F. (460° to 538° C.) and the temperature in said calcination zone is from about 1400° F. to about 1600° F. (760° to 871° C.).

14. The process of claim 11 wherein the carbon oxide content of said reducing gas does not exceed about 1 vol.%.

15. The process of claim 11 wherein the gas evolved in said carbonization zone or in said calcination zone is essentially free of nitrogen and is treated to removed carbon dioxide, and the resultant gas of diminished carbon dioxide content is passed through said cooling-desulfurization zone as said reducing gas.

16. The process of claim 11 wherein the effluent gas from said cooling-desulfurization is passed through a heat exchanger for recovery of heat before removing hydrogen sulfide.

17. The process of claim 11 wherein said hot, calcined, sulfur-containing char is cooled and desulfurized in a first cooling stage by contacting the char with said reducing gas and is thereafter cooled further in a second cooling stage by contacting the char with an inert gas.

18. The process of claim 17 wherein the hot, calcined, sulfur-containing char is cooled to a temperature not lower than about 800° F. (427° C.) in said first stage and to about 200° F. (93° C.) or less in said second stage.

19. The process of claim 17 wherein a fluid stream is passed successively in heat exchange relation with the effluent gases from each of said cooling stages to recover heat from said gases.

* * * * *